US006752397B2

(12) United States Patent
Kohli et al.

(10) Patent No.: US 6,752,397 B2
(45) Date of Patent: Jun. 22, 2004

(54) REDUNDANT METAL-METAL SEAL

(75) Inventors: Harjit S. Kohli, Sugar Land, TX (US); Hebah Ahmed, Houston, TX (US); Anthony F. Veneruso, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 28 days.

(21) Appl. No.: 10/024,410

(22) Filed: Dec. 18, 2001

(65) Prior Publication Data

US 2003/0111796 A1 Jun. 19, 2003

(51) Int. Cl.[7] ..... E21B 33/00

(52) U.S. Cl. ..... 277/322; 277/377; 277/342; 166/118

(58) Field of Search ..... 277/322, 330, 277/337, 339, 342, 619; 116/118

(56) References Cited

U.S. PATENT DOCUMENTS 4,390,186 A * 6/1983 McGee et al. ..... 277/322
4,751,965 A * 6/1988 Cassity ..... 166/182
4,791,987 A * 12/1988 Cassity et al. ..... 166/182
5,070,942 A * 12/1991 McInnes ..... 166/115
5,148,870 A * 9/1992 Fernandez et al. ..... 166/344
5,211,226 A * 5/1993 Hendrickson et al. ..... 166/118
5,224,715 A * 7/1993 Downes et al. ..... 277/322
5,464,063 A * 11/1995 Boehm, Jr. ..... 166/382
5,833,490 A 11/1998 Bouldin
6,056,327 A 5/2000 Bouldin et al.
6,510,895 B1 * 1/2003 Koleilat et al. ..... 166/208

OTHER PUBLICATIONS

SPE Paper 55996. Rusch, David W. et al., "Use of Pressure Activated Sealants to Cure Sources of Casing Pressure," (Anchorage, Alaska; May 1999).

SPE Paper 59026. Mendoza, Miguel A. et al., "Leak–Sealant in Hydraulic Systems Minimizes Maintenance Costs in Offshore Wells," (Villhermosa, Mexico; Feb. 2000).

SPE Paper 64400. Eaton, M.L. et al., "New Workover and Completion Technology Utilized in Bass Strait," (Brisbane, Australia; Oct. 2000).

* cited by examiner

*Primary Examiner*—William L. Miller
(74) *Attorney, Agent, or Firm*—Van Someren, PC; Jeffrey E. Griffin; Brigitte Jeffery Echols

(57) ABSTRACT

A sealing assembly for protecting a downhole connection is disclosed. The sealing assembly includes independently energized metal—metal seals and a housing that prevents the energization of individual seals from affecting other seals.

27 Claims, 2 Drawing Sheets

REDUNDANT METAL-METAL SEAL

FIELD OF THE INVENTION

The subject matter of the present invention relates to providing redundant metal—metal seals to protect downhole communication lines from the surrounding environment.

BACKGROUND OF THE INVENTION

Communication lines are used in a wide range of applications in the oilfield industry. The communication lines transmit monitored data regarding downhole conditions such as temperature and pressure to surface instrumentation. The communication lines can also be used to send information down the well from the surface. Additionally, communication lines may also be used to electrically power downhole equipment. Communication lines may include electrical conduits, optical fibers, hydraulic lines and other methods for data or power transmission.

In environments such as those encountered in downhole wells, the communication lines are exposed to hostile conditions such as elevated temperatures and pressures. To protect the fragile communication lines from the hostile conditions, the communication lines are generally carried within protective tubing that provides an environmental seal. Problems arise when the seal must be broken during assembly, installation and/or repair of the communication line. For example, in downhole applications, in order for the communication line to be fed through production equipment such as packers, the line must be cut and then spliced with the downstream line. Thus, after splicing, the communication line must once again be sealed from the harsh environment.

There exists, therefore, a need for an apparatus and method of sealing communication lines from the surrounding environment.

DETAILED DESCRIPTION OF PREFERRED EMBODIMENTS

In the following detailed description of the subject matter of the present invention, the apparatus and method of providing redundant metal—metal seals for communication lines is principally described with reference to downhole well applications. Such description is intended for illustration purposes only and is not intended to limit the scope of the present invention. In addition to downhole well applications, the present invention can be used with any number of applications such as pipeline monitoring, subsea well monitoring, and data transmission, for example. Furthermore, the communication lines may comprise electrical wiring, fiber optic wiring, hydraulic lines, or any other type of line which may facilitate transfer of information, power, or both. All such types of communication lines are intended to fall within the purview of the present invention. However, for purposes of illustration, the present invention will be principally described as being used in downhole well applications.

Figure 1:
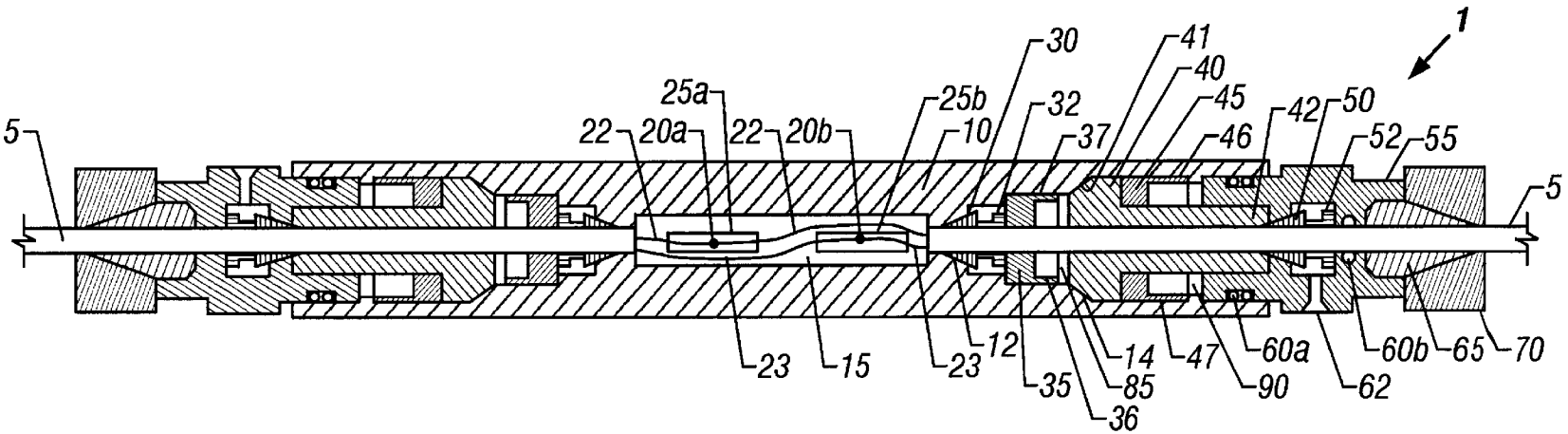
FIG. 1 provides a sketch of a downhole electric splice assembly that incorporates the redundant metal—metal seal assembly.

FIG. 1 provides a sketch of a downhole electric splice assembly that incorporates the redundant metal—metal seal assembly, indicated generally as numeral 1, of the present invention. In FIG. 1, the cables 5 are spliced together within a housing 10. Each of the cables 5 are carrying two communication lines 22, 23 from which spliced connections 20*a*, 20*b* are formed. The spliced connections 20*a*, 25*b* are located within an internal cavity 15 within the housing 10 and are each housed within protective casings 25*a*, 25*b*.

It should be noted that the spliced connections 25*a*, 25*b* shown in FIG. 1 are intended to illustrate one possible application of the present invention, and are not intended to limit the inventions scope. The present invention can be used with all types of communication line connections and is not limited to spliced connections.

The primary metal—metal seal is formed by a pair of ferrules 30, 32. The primary seal is energized and held in place by action of the primary retainer 35. In the embodiment shown, the primary retainer 35 comprises securing dogs 36 and a threaded outer diameter 37. The securing dogs 36 correspond to mating dogs on an installation tool (not shown). In one embodiment, the installation tool has a circumferential gap that enables it to be installed and removed over the cable 5. The installation tool is used to apply torque to the primary retainer 35, which in turn imparts a swaging load on the ferrules 30, 32 and imparts contact stress between the ferrules 30, 32 and the cable 5 and between the ferrules 30, 32 and the housing 10. As such, a seal is formed by the ferrules 30, 32 between the housing 10 and the cable 5. The swaging load and contact stress, and thus the seal, is maintained by the threaded outer diameter 37 of the primary retainer 35.

It should be noted that the above description of the primary retainer 35 is exemplary of one particular embodiment of the retainer 35, and is not intended to limit the scope of the invention. There are any number of embodiments of the primary retainer 35 that can be used to advantage in the sealing assembly 1. The primary retainer 35 is any means capable of energizing the ferrules 30, 32 and maintaining the primary seal.

In some instances, to ensure a proper seal, it may be necessary to coat the ferrules 30, 32 with a soft metal such as gold. Typical cable 5 are characterized by non-circularity or non-uniformity of surface. Although the process of swaging the ferrules 30, 32 on the cable 5 deforms the surface considerably, often it is not enough to provide sufficient local contact stresses between the ferrules 30, 32 and the troughs existing in the surface of the cable 5. Thus, the metal—metal seal cannot withstand a substantial pressure differential for a long duration of time. Coating the ferrules 30, 32 with a soft metal causes the troughs to be filled with the soft metal, substantially increasing the local contact stresses.

The secondary metal—metal seal is formed by a seal element 40 having a conical section 41 that corresponds with a mating section 14 of the housing 10. The secondary metal—metal seal provides redundancy to prevent leakage between the housing 10 and the seal assembly 1. The conical section 41 is forced into sealing contact with the mating section 14 by action of a secondary retainer 45. Similar to the primary retainer 35, the secondary retainer 45 comprises securing dogs 46 and a threaded outer diameter 47. As with the primary retainer 35, an installation tool (not shown) is used to apply torque to the secondary retainer 45, which in turn imparts contact stress between the conical section 41 and the mating section 14 to form a seal therebetween. The contact stress of the shouldered contact is maintained by the threaded outer diameter 47 of the secondary retainer 45. It should be noted that the primary gap 85 that exists between the primary retainer 35 and the seal element 40 ensures that the process of energizing the secondary metal—metal seal does not affect the contact stresses on the primary seal between the housing 10 and the cable 5. It should further be noted that in one embodiment, the seal element 40 comprises one or more ferrules forced into sealing contact with the mating section 14 of the housing 10.

As discussed above with reference to the primary retainer 35, it should be noted that the description of the secondary retainer 45 is exemplary of one particular embodiment of the retainer 45, and is not intended to limit the scope of the invention. There are any number of embodiments of the secondary retainer 45 that can be used to advantage in the sealing assembly 1. The secondary retainer 45 is any means capable of energizing and maintaining the secondary seal.

The tertiary metal—metal seal is formed by a pair of ferrules 50, 52 that engage the end 42 of the seal element 40. The tertiary metal—metal seal, energized by the end plug 55, provides redundancy to prevent leakage between the cable 5 and the seal assembly 1. As with the ferrules 30, 32 of the primary seal, in certain instances, the ferrules 50, 52 of the secondary seal are coated with a soft metal to increase the local contact stresses with the cable 5. A secondary gap 90 exists between the secondary retainer 45 and the end plug 55 that prevents the energizing load from affecting the mating components on the secondary seal. Load transmitted to the end of the secondary retainer 45 is dissipated through the end plug 55 to the housing 10. The end plug 55 further comprises a pressure port 62 and one or more elastomeric seals 60*a*, 60*b* that enable pressure testing (as will be discussed below) of the seal assembly 1.

To isolate all the seals from axial loading, vibration and shock conveyed from the cables 5*a*, 5*b*, an anchor 65 is energized against the cable 5 by action of the end nut 70. In one embodiment, the anchor 65 is a collet style anchor.

Figure 2:
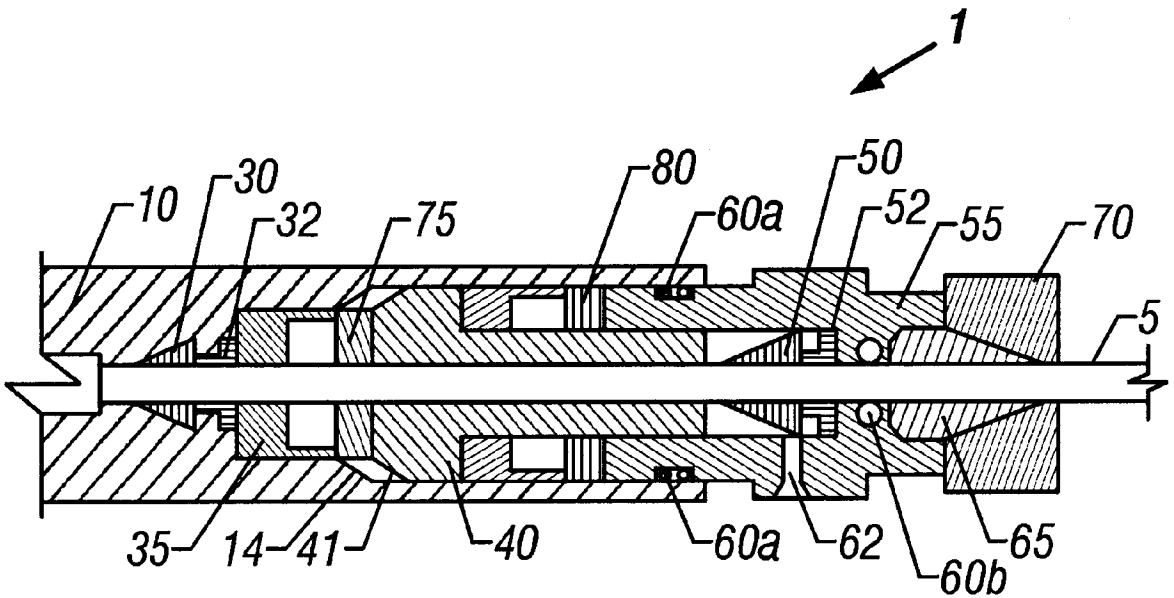
FIG. 2 provides an illustration of the configuration of the seal assembly 1 used to pressure test the primary seal.

FIG. 2 provides an illustration of the configuration of the seal assembly 1 used to pressure test the primary seal. Testing of the primary seal requires insertion of spacers 75, 80 to prevent accidentally engaging the secondary and tertiary seals. In one embodiment, the spacers 75, 80 are constructed with a circumferential gap to enable installation and removal from the seal assembly 1. The first spacer 75 prevents the conical section 41 of the seal element 40 from contacting the mating section 14 of the housing 10 to form the secondary metal—metal seal. Likewise, the second spacer 80 prevents the ferrules 50, 52 from engaging the end 42 of the seal element 40 to form a seal. To test, fluid is pumped through the pressure port 62. The fluid is prevented from escaping the housing 10 opposite the primary seal by the one or more elastomeric seals 60*a*, 60*b*. After testing, the spacers 75, 80 are removed and the seal cavity is cleared of the test fluid. Subsequently, the secondary and tertiary seals are energized as described above, and the anchor 65 is installed and energized.

In one embodiment, pressure testing of the secondary and tertiary seals is done by pumping a fluid that cures into a gel under downhole conditions through the pressure port 62. After testing, the pressure port 62 is plugged to maintain the gel within the seal assembly 1. The gel protects the secondary and tertiary seals from corrosion due to exposure to completion or produced fluids. Further, the gel acts to protect the seals from the effects of shock and vibration.

Referring back to FIG. 1, one method of verifying successful secondary and tertiary sealing is achieved by use of a chemical that produces an exothermic reaction when exposed to the test fluid. In this method, the chemical is deposited via porous bags into the interior of the housing 10. Failure of either seal causes the test fluid to invade the interior of the housing 10 and the resultant differential temperature increase can be read by thermal strips (not shown) placed on the outer diameter of the housing 10.

Another method of verifying successful secondary and tertiary sealing is to load the interior of the housing 10 with a porous bag containing small hollow beads made of a material that emits noise upon failure. The increase of pressure in the interior of the housing 10 due to a failed seal causes the hollow beads to fail, emitting a sound that can be picked up by a sonic sensor.

Yet another method of verifying successful secondary and tertiary sealing include using an ultrasonic sensor to detect the presence of test fluid in the interior of the housing 10. Similarly, a sonic sensor can be used to detect the change in acoustic response due to test fluid in the interior of the housing 10. A portable x-ray machine can also be used to detect the presence of test fluid in the interior of the housing 10.

The invention being thus described, it will be obvious that the same may be varied in many ways. For example, it is not necessary that one or both gaps 85, 90 exist within the seal assembly 1. The gaps 85, 90 are useful to allow independent loading, prevent undue loading and to enable various pressure testing methods, but are not necessary for the function of the seal assembly 1. Such variations are not to be regarded as a departure from the spirit and scope of the invention, and all such are intended to be included within the scope of the following non-limiting claims:

What is claimed is:

1. A sealing assembly for a downhole connection, comprising:

a primary metal—metal seal;

at least one independently energized redundant metal—metal seal; and a housing defining an interior that prevents the energization of the at least one independently energized redundant metal—metal seal from affecting the contact stresses on the primary metal—metal seal, wherein the primary metal—metal seal comprises a pair of ferrules.

2. The downhole sealing assembly of claim 1, wherein the pair of ferrules are coated with a soft metal.

3. The downhole sealing assembly of claim 2, wherein the soft metal is gold.

4. The downhole sealing assembly of claim 1, wherein the at least one independently energized redundant metal—metal seal comprises a pair of ferrules.

5. The downhole sealing assembly of claim 4, wherein the pair of ferrules are coated with a soft metal.

6. The downhole sealing assembly of claim 5, wherein the soft metal is gold.

7. The downhole sealing assembly of claim 1, wherein the at least one independently energized redundant metal—metal seal comprises a shouldered contact.

8. The downhole sealing assembly of claim 1, further comprising at least one gap between the primary metal—metal seal and the at least one independently energized redundant metal—metal seal.

9. A sealing assembly for a connection, comprising:

a primary metal—metal seal energized by a primary retainer;

a secondary metal—metal seal energized by a secondary retainer, said energization having no effect on the contact stresses of the primary metal—metal seal;

a tertiary metal—metal seal energized by a tertiary retainer, said energization having no effect on the contact stresses of the secondary metal—metal seal and having no effect on the contact stresses of the primary metal—metal seal; and a housing.

10. The sealing assembly of claim 9, wherein the primary metal—metal seal is a pair of ferrules.

11. The sealing assembly of claim 9, wherein the pair of ferrules are coated with a soft metal.

12. The sealing assembly of claim 9, wherein the primary retainer comprises securing dogs adapted for receipt of an installation tool.

13. The sealing assembly of claim 9, wherein the primary retainer comprises threads adapted to maintain the energizing load on the primary metal—metal seal.

14. The sealing assembly of claim 9, wherein the primary retainer is integral with the primary metal—metal seal.

15. The sealing assembly of claim 9, wherein the secondary metal—metal seal is a shouldered contact.

16. The sealing assembly of claim 9, wherein the secondary retainer comprises securing dogs adapted for receipt of an installation tool.

17. The sealing assembly of claim 9, wherein the secondary retainer comprises threads adapted to maintain the energizing load on the secondary metal—metal seal.

18. The sealing assembly of claim 9, wherein the secondary retainer is integral with the secondary metal—metal seal.

19. The sealing assembly of claim 9, wherein the secondary metal—metal seal is a pair of ferrules.

20. The sealing assembly of claim 9, wherein the tertiary metal—metal seal is a pair of ferrules.

21. The sealing assembly of claim 19 or 20, wherein the pair of ferrules are coated with a soft metal.

22. The sealing assembly of claim 9, wherein the tertiary retainer comprises an end plug.

23. The sealing assembly of claim 9, further defining a primary gap located between the primary metal—metal seal and the secondary metal—metal seal.

24. The sealing assembly of claim 9, further defining a secondary gap located between the secondary metal—metal seal and the tertiary metal—metal seal.

25. A sealing assembly for a connection, comprising:

a primary metal—metal seal energized by a first energizing means;

a secondary metal—metal seal energized by a second energizing means;

a tertiary metal—metal seal energized by a third energizing means;

means to prevent the energization of the secondary metal—metal seal from affecting the contact stresses of the primary metal—metal seal; and means to prevent the energization of the tertiary metal—metal seal from affecting the contact stresses of the secondary metal—metal seal.

26. A downhole sealing assembly, comprising:

a housing having an internal cavity;

a connection located within the internal cavity of the housing;

a primary metal—metal seal energized by a retainer and adapted to prevent fluid from entering the internal cavity; and one or more additional metal—metal seals energized by a member independent of the retainer, the one or more additional metal—metal seals being adapted to prevent fluid from reaching the primary metal—metal seal and to prevent affecting the contact stresses of the primary metal—metal seal upon energization, wherein the housing is filled with a gel adapted to protect the one or more additional metal—metal seals from exposure to corrosive fluids.

27. A method of protectively sealing a downhole connection, comprising:

providing a housing having the downhole connection within;

providing a primary metal—metal seal adapted to prevent fluid from contacting the downhole connection within the housing;

providing one or more redundant metal—metal seals energized by a force independent of the force applied to energize the primary metal—metal seal, the one or more redundant metal—metal seals being adapted to prevent fluid from contacting the primary metal—metal seal;

preventing the energization of the one or more independently energized redundant metal—metal seals from affecting the contact stresses of the primary metal—metal seal; and providing a gel within the housing adapted to protect the one or more redundant metal—metal seals from contact with corrosive fluids.

* * * * *